US011384769B2

(12) United States Patent
Huang et al.

(10) Patent No.: US 11,384,769 B2
(45) Date of Patent: Jul. 12, 2022

(54) SMART ELECTRIC AIR PUMP

(71) Applicant: BESTWAY INFLATABLES & MATERIAL CORP., Shanghai (CN)

(72) Inventors: Shuiyong Huang, Shanghai (CN); Wanbin Qiu, Shanghai (CN); Ruojin Yin, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 209 days.

(21) Appl. No.: 16/843,883

(22) Filed: Apr. 9, 2020

(65) Prior Publication Data

US 2020/0256345 A1 Aug. 13, 2020

(30) Foreign Application Priority Data

Feb. 12, 2019 (CN) ..... 201920190815.9

(51) Int. Cl.

*F04D 25/16* (2006.01)
*F04D 25/06* (2006.01)
*A47C 27/08* (2006.01)

(52) U.S. Cl.

CPC ..... *F04D 25/16* (2013.01); *A47C 27/082* (2013.01); *F04D 25/068* (2013.01); *F04D 25/0666* (2013.01)

(58) Field of Classification Search

CPC .... F04D 25/0666; F04D 25/068; F04D 25/16; F04D 27/001; F04D 29/541; A47C 27/082; A47C 27/084

See application file for complete search history.

(56) References Cited

U.S. PATENT DOCUMENTS 5,509,154 A 4/1996 Shafer et al.
9,541,096 B2 * 1/2017 Tsai ..... F04D 29/4226

(Continued)

FOREIGN PATENT DOCUMENTS

| | | |
|---|---|---|
| CN | 208456798 | 2/2019 |
| EP | 3674560 | 7/2020 |
| KR | 20170051877 | 5/2017 |

OTHER PUBLICATIONS

Extended European Search Report dated Jun. 19, 2020 (Jun. 19, 2020) issued on related European patent application 20168911.4 by the European Patent Office.

(Continued)

*Primary Examiner* — Richard A Edgar
*Assistant Examiner* — Jason G Davis
(74) *Attorney, Agent, or Firm* — Dickinson Wright PLLC

(57) ABSTRACT

A smart air pump comprises a housing defining an accommodating chamber. A main air pump is located in the accommodating chamber for inflating or discharging air from an inflatable body. The main air pump includes a cover defining an inlet and an outlet port. The cover divides the accommodating chamber into an impeller and a driving chamber. An air replenishing pump is located in the accommodating chamber. A driving switch, located in the driving chamber, connects to the main air pump. A central control unit electrically connects to the main air pump, the air replenishing pump, and the driving switch. The central control unit comprises a time control module configured to initiate periodic replenishment of air to the inflatable body. The time control module has a setting module and a counting module. An inflatable device including a smart air pump is also disclosed herein.

24 Claims, 17 Drawing Sheets

(56) References Cited

U.S. PATENT DOCUMENTS

| | | | | |
|---|---|---|---|---|
| 2011/0284108 | A1* | 11/2011 | Wang | G05D 16/16<br>137/565.12 |
| 2017/0196368 | A1* | 7/2017 | Liu | A47C 27/16 |
| 2017/0280884 | A1* | 10/2017 | Liu | A47C 27/083 |
| 2018/0335042 | A1 | 11/2018 | Lin et al. | |
| 2019/0301476 | A1 | 10/2019 | Huang et al. | |

OTHER PUBLICATIONS

Communication pursuant to Article 94(3) EPC dated Feb. 22, 2022 (Feb. 22, 2022) issued on related European Patent Application by the European Patent Office.

* cited by examiner

SMART ELECTRIC AIR PUMP

CROSS REFERENCE TO RELATED APPLICATION

The present application claims priority to Chinese Patent Application Ser. No. CN201920190815.9, filed on Feb. 12, 2019, the entire disclosure of which is hereby incorporated herein by reference.

RELATED FIELD

The present invention generally relates to an air pump and, in particular, the present invention relates to a smart electric air pump for inflating an inflatable product.

BACKGROUND

An air pump is one of the necessary components for an inflatable product (such as an inflatable mattress, an inflatable bed and an inflatable toy). A manual air pump and a hand-held electric air pump may be used to inflate the inflatable product through an air valve on the inflatable product. A built-in electric air pump mounted on the inflatable product (e.g., an inflatable mattress) may be used to inflate the inflatable product. The user can manually open or close the switch of the electric air pump to start or stop inflating the inflatable product. Compared to the manual air pump and the hand-held electric air pump, the built-in electric air pump is more convenient to use and allows for a higher rate of inflation.

Whether the inflatable product is inflated to an appropriate air pressure has a direct impact on user's experience and on the life of the inflatable product. For example, if the air pressure is low for an inflatable mattress, the mattress would be soft and cannot provide sufficient support to the user. On the other hand, if the air pressure is too high for the inflatable mattress, the mattress would expand and deform and being susceptible to be easily damaged. Without a barometer, the air pressure of the inflatable product can only be determined by manually pressing the inflatable product during inflation. This method is neither convenient, nor accurate. In addition, this method prolongs the inflation time of the inflatable product.

Current inflatable products are made from thermoplastic fabric. After inflation, the inflatable product can expand and deform to a certain degree, and the air pressure inside the inflatable product becomes lower in response to the expansion or deformation. Accordingly, it would be difficult to maintain the air pressure inside the inflatable product in a relatively constant range for a long period of time. Manual air pumps, hand-held electric air pumps and most of the built-in electric air pumps in the prior art cannot periodically and/or automatically detect the air pressure inside the inflatable product and automatically perform air replenishing operations such that a user need not manually and repeatedly inflate the inflatable product, which causes inconvenience to the user.

SUMMARY

A purpose of the present invention is to overcome the defects in the prior art, at least as described above, and to provide a smart electric air pump. The smart electric air pump can periodically and automatically detect air pressure inside the inflatable product to automatically replenish air in the inflatable product when necessary, thus maintaining the air pressure inside the inflatable product in a relatively constant range for a long time.

It is one aspect of the present invention to provide a smart air pump for an inflatable body. The smart air pump comprises a housing defining an accommodating chamber. A main air pump, located in the accommodating chamber, is configured to inflate or discharge air from the inflatable body. The main air pump includes a cover defining an inlet port and an outlet port. The cover divides the accommodating chamber into an impeller chamber and a driving chamber with the impeller chamber extending between the housing and the cover. The driving chamber is in fluid communication with an outer environment of the smart air pump. An air replenishing pump is located in the accommodating chamber and adjacent to the main air pump for replenishing air to the inflatable body. A driving switch, located in the driving chamber, connects to the main air pump and is configured to perform air passage switching. A central control unit, located in the driving chamber, is electrically connected to the main air pump, the air replenishing pump, and the driving switch. The central control unit comprises a time control module configured to initiate periodic replenishment of air to the inflatable body. The time control module has a setting module for setting a cycle time and a counting module for counting the cycle time.

According to an embodiment of the present invention, the cycle time can be greater than or equal to thirty seconds.

According to an embodiment of the present invention, the cycle time can be sixty seconds, five minutes, ten minutes, thirty minutes, or one hour.

According to an embodiment of the present invention, after activating an inflation function of the smart air pump and deactivating an inflation function of the main air pump, the counting module can begin counting for the cycle time. When the counting reaches an end of the cycle time, the air replenishing pump can begin to replenish air until an air pressure inside the inflatable body is greater than or equal to a preset air pressure.

According to an embodiment of the present invention, the counting module can reset upon reaching the end of the cycle time.

According to an embodiment of the present invention, the driving switch can include an actuator and an air passage switch. The actuator can be in electrical communication with the central control unit and can be configured to activate in response to receiving a start signal from the center control unit. The air passage switch can be in fluid communication with the outlet port and the outer environment. The air passage switch can couple to the actuator such that the actuator moves the air passage switch to establish an inflation air passage configuration, a deflation air passage configuration, or a closed air passage configuration.

According to an embodiment of the present invention, the actuator can comprise a commutation motor.

According to an embodiment of the present invention, the driving switch can include at least one position signal generator located in the driving chamber. The at least one position signal generator can couple to the air passage switch and can be in electrical communication with the central control unit.

According to an embodiment of the present invention, the at least one position signal generator can comprise a first signal generator, a second signal generator, and a third signal generator. The first signal generator can be configure to generate and send a position signal to the central control unit in response to the air passage switch establishing the inflation air passage configuration. The second signal generator can be configured to generate and send a position signal to the central control unit in response to the air passage switch establishing the deflation air passage configuration. The third signal generator can be configured to generate and send a position signal to the central control unit in response to the air passage switch establishing the closed air passage configuration.

According to an embodiment of the present invention, the air passage switch can include an outer tube and inner tube. The outer tube can be in fluid communication with the inflatable body and the outlet port. The inner tube can fit within the outer tube. The inner tube can be rotatable and axially movable within the outer tube and is in fluid communication with the outer environment.

According to an embodiment of the present invention, the outer tube can define a first opening, a second opening, a third opening, a fourth opening, and an inlet channel. A first opening can be located at a first end of the outer tube for receiving the inner tube. A second opening can be located at a second end of the outer tube. The second opening can be in fluid communication with the inflatable body. The third opening, located on an outer tube wall and adjacent to the first end of the outer tube, can be in fluid communication with is driving chamber. The fourth opening, located on the outer tube wall and axially spaced apart from the third opening and adjacent to the second end of the outer tube, can be in fluid communication with the driving chamber. The inlet channel can connect to the outlet port.

According an embodiment of the present invention, the inner tube can define a fifth opening, a sixth opening, a seventh opening, and an eighth opening. The fifth opening, a first end of the inner tube, can be in fluid communication with the outer environment. The sixth opening, located at a second end of the inner tube, can be in fluid communication with the inflatable body. The seventh opening can be located on an inner tube wall and adjacent to the first end of the inner tube. The eighth opening can be located on the inner tube wall, opposite of the seventh opening and adjacent to the second end of the inner tube. A separator, located in the inner tube, can divide an interior of the inner tube into two spaces wherein the seventh opening and the eighth opening can be provided on opposite sides of the separator.

According to an embodiment of the present invention, the air replenishing pump can comprise a core, at least one pivot arm, and an electromagnetic device. The core can define an inlet port, an outlet port, and a core opening. The at least one pivot arm can include a magnet and a cup. The magnet and the cup can couple to the at least one pivot arm. The cup can couple to the core and covering the core opening to define an air chamber. The electromagnetic device can be configured to generate magnetic flux causing the magnet and the at least one pivot arm to move, thereby causing the cup to compress and expand the air chamber.

According to an embodiment of the present invention, in response to the cup expanding the air chamber, the air replenishing pump can draw air into the air chamber through a first one-way valve located at the inlet port. In response to the cup compressing the air chamber, the air replenishing pump can discharge air from the air chamber through a second one-way valve located at the outlet port.

According to an embodiment of the present invention, the at least one pivot arm can comprise a pair of pivot arms located on opposing sides of the core and covering the core opening.

According to an embodiment of the present invention, the air replenishing pump can include a base, the core being coupled to the base.

According to an embodiment of the present invention, the base can define a first groove and a second groove. The first groove can be in fluid communication with the inlet port to establish a first air passage for directing air into the air chamber via the inlet port. The second groove can be in fluid communication with the outlet port for directing air to the outer environment.

It is another aspect of the present invention to provide an inflatable device. The inflatable device comprises an inflatable body and a smart air pump. The smart air pump, located in the inflatable body, comprises a housing defining an accommodating chamber. A main air pump, located in the accommodating chamber, is configured to inflate or discharge air from the inflatable body. The main air pump includes a cover defining an inlet port and an outlet port. The cover divides the accommodating chamber into an impeller chamber and a driving chamber. The impeller chamber extends between the housing and the cover. The driving chamber is in fluid communication with an outer environment of the smart air pump. An air replenishing pump is located in the accommodating chamber and adjacent to the main air pump for replenishing air to the inflatable body. A driving switch, located in the driving chamber, connects to the main air pump and is configured to perform air passage switching. A central control unit, located in the driving chamber, electrically connects to the main air pump, the air replenishing pump, and the driving switch. The central control unit comprises a time control module configured to initiate periodic replenishment of air to the inflatable body. The time control module has a setting module for setting a cycle time and a counting module for counting the cycle time.

According to an embodiment of the present invention, the inflatable body can include a top sheet, a bottom sheet, and an enclosing sheet. The enclosing sheet can connect the top sheet with the bottom sheet to define an interior cavity extending between the top sheet, the bottom sheet, and the enclosing sheet.

According to an embodiment of the present invention, the inflatable device can include a plurality of reinforcing members located in the interior cavity and connected to the top sheet and the bottom sheet.

According to an embodiment of the present invention, the inflatable body can comprise an inflatable bed, an inflatable mattress, an inflatable boat, or an inflatable toy.

According to an embodiment of the present invention, the air replenishing pump can include a core, at least one pivot arm, and an electromagnetic device. The core can define an inlet port, an outlet port, and a core opening. The at least one pivot arm can include a magnet and a cup. The magnet and the cup can couple to the at least one pivot arm. The cup can couple to the core and covering the core opening to define an air chamber. An electromagnetic device can be configured to generate magnetic flux causing the magnet and the at least one pivot arm to move, thereby causing the cup to compress and expand the air chamber.

According to an embodiment of the present invention, in response to the cup expanding the air chamber, the air replenishing pump can draw air into the air chamber through a first one-way valve located at the inlet port. In response to the cup compressing the air chamber, the air replenishing pump can discharge air from the air chamber through a second one-way valve located at the outlet port.

According to an embodiment of the present invention, the at least one pivot arm can comprise a pair of pivot arms located on opposing sides of the core and covering the core opening.

According to an embodiment of the present invention, the air replenishing pump can include a base, the core being coupled to the base.

According to an embodiment of the present invention, the base can define a first groove and a second groove. The first groove can be in fluid communication with the inlet port to establish a first air passage for directing air into the air chamber via the inlet port. The second groove can be in fluid communication with the outlet port for directing air to the outer environment.

According to an embodiment of the present invention, the cycle time can be greater than or equal to thirty seconds.

According to an embodiment of the present invention, the cycle time can be sixty seconds, five minutes, ten minutes, thirty minutes, or one hour.

According to an embodiment of the present invention, after activating an inflation function of the smart air pump and deactivating an inflation function of the main air pump, the counting module can begin counting for the cycle time. When the counting reaches an end of the cycle time, the air replenishing pump can begin to replenish air until an air pressure inside the inflatable body is greater than or equal to a preset air pressure.

According to an embodiment of the present invention, the counting module can reset upon reaching the end of the cycle time.

BRIEF DESCRIPTION OF THE DRAWINGS

Other features and advantages of the present disclosure will be better understood from the preferred embodiments described in detail with reference to the accompanying drawings, in which the same reference numerals are used to designate the same or similar components.

DETAILED DESCRIPTION OF THE INVENTION

Figure 1:
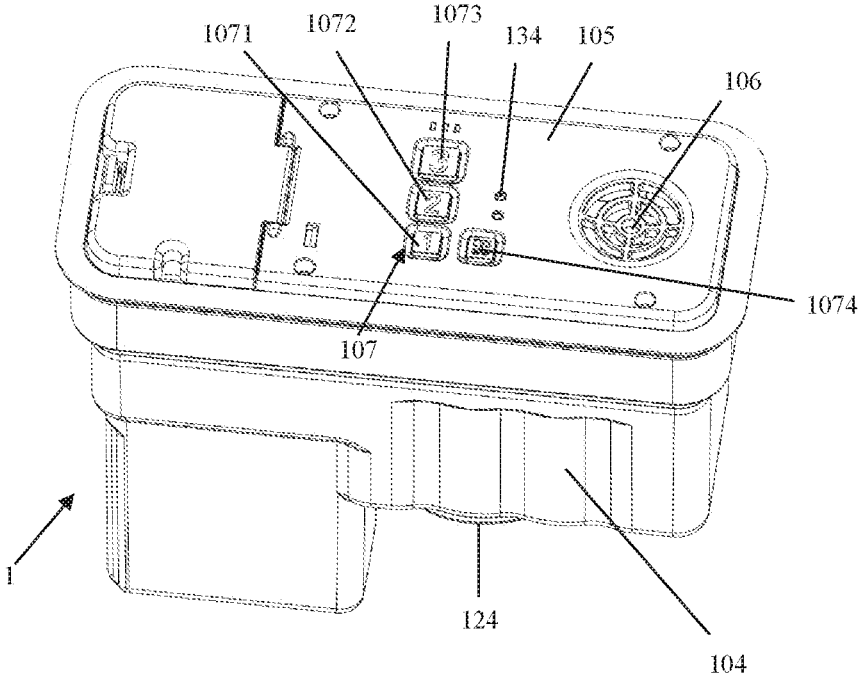
FIG. 1 is a perspective view of a smart air pump constructed in accordance with one embodiment of the present invention.
Figure 2:
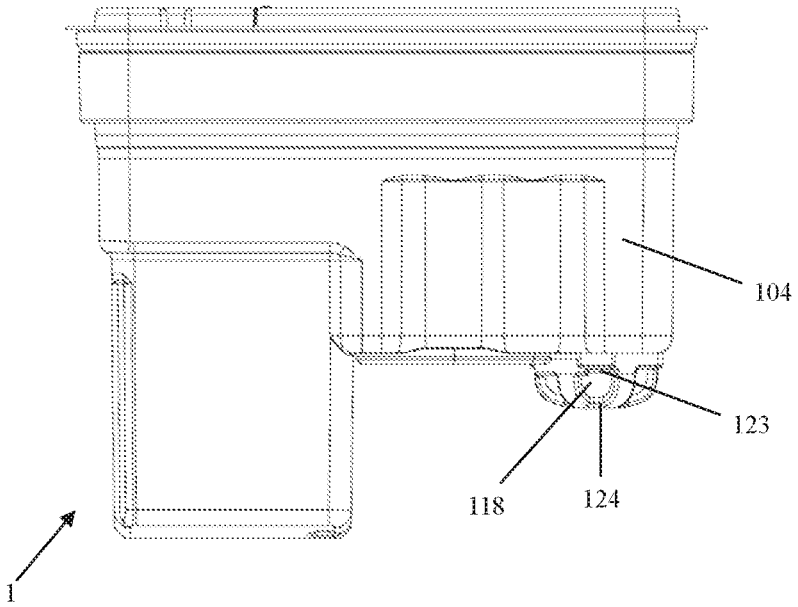
FIG. 2 is a side view of the smart air pump.

The implementation and usage of the embodiments of the present invention will be discussed in detail below. However, it should be understood that the specific embodiments of the present invention discussed herein are merely illustrative of specific ways to implement and use the present invention and do not limit the scope of protection of the present invention.

FIGS. 1 to 8 illustrate a smart air pump 1 constructed in accordance with an embodiment of the present invention. The smart air pump 1 includes a main air pump 101, an air replenishing pump 20, a driving switch 102, an air pressure sensor 149, a central control unit 103, a housing 104, and a panel 105.

The main air pump 101 is configured to inflate the inflatable body (for example, an inflatable mattress) or deflate the inflatable body. The air replenishing pump 20 is configured to automatically replenish air in the inflatable body. The driving switch 102 couples to the main air pump 101 and is capable of performing air passage switching. The air pressure sensor 149 is in communication with the inflatable body to detect the air pressure inside the inflatable body.

The central control unit 103 is coupled to the main air pump 101, the air replenishing pump 20, the driving switch 102, and the air pressure sensor 149. The central control unit 103 contains a program for sending a drive signal to actuate the driving switch 102 to start air passage switching, and for sending a start signal or a stop signal to the main air pump 101 to respectively activate or deactivate the main air pump 101, based on the air pressure inside the inflatable product detected by the air pressure sensor 149 in reference to a preset inflation pressure. The main air pump 101, the air replenishing pump 20, the air pressure sensor 149, and the central control unit 103 are located in an accommodating chamber of the housing 104. According to an embodiment of the present invention, the central control unit 103 can be, for example, a PCB (Printed Circuit Board) control unit.

Figure 3:
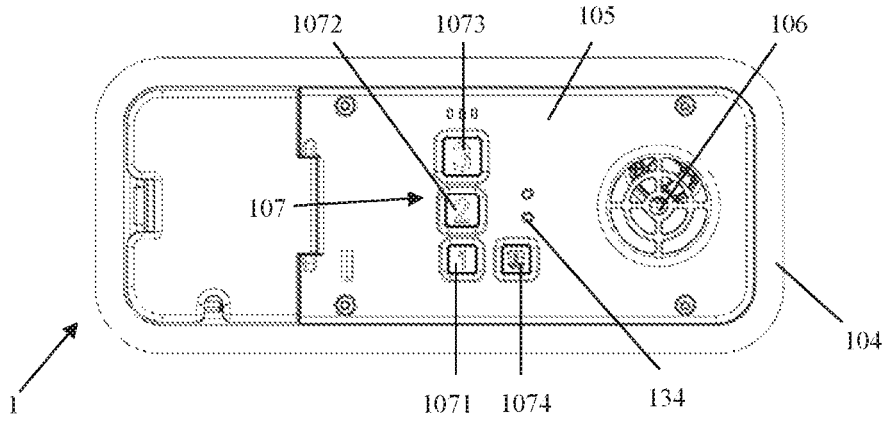
FIG. 3 is a top view of the smart air pump.

As shown in FIGS. 1 and 3, the panel 105 covers one side of the housing 104. The panel 105 defines a first venting hole 106. In addition, the panel 105 may also include an input unit 107. The input unit 107 connects to the central control unit 103. The input unit 107 can include an inflation signal input, a deflation signal input, and a stop signal input. The inflation signal input, the deflation signal input, and the stop signal input respectively send an inflation signal, a deflation signal, and a stop signal to the central control unit 103.

According to an embodiment of the present invention, the input unit 107 includes a first inflation signal input 1071, a second inflation signal input 1072, a third inflation signal input 1073, and a deflation signal input 1074. It should be appreciated that the first inflation signal input 1071, the second inflation signal input 1072, and the third inflation signal input 1073 correspond to three different preset inflation pressures. For example, in response to a user pressing any one of the above four inputs, a corresponding inflation signal or deflation signal is sent to the central control unit 103, and when a user presses the same input again, a corresponding deactivation signal is generated. According to an embodiment of the present invention, the input unit 107 can also include a deactivation signal input provided separately from the first inflation signal input 1071, the second inflation signal input 1072, the third inflation signal input 1073, and the deflation signal input 1074, wherein, in response to a user pressing any one of the above four inputs, a corresponding inflation signal or deflation signal is sent to the central control unit 103, and when a user presses the deactivation signal input, a corresponding deactivation signal is generated to the central control unit 103.

The panel 105 include a display unit. The display unit is coupled to the central control unit 103 for receiving a display signal in response to an inflation state or a deflation state, generated by the central control unit 103. In the embodiment shown in FIGS. 1 and 3, the display unit is a display light 134 located adjacent the first inflation signal input 1071, the second inflation signal input 1072, the third inflation signal input 1073, and the deflation signal input 1074.

According to an embodiment of the present invention, the central control unit 103 can further include a main control unit 1031 and an input control unit 1032. The main control unit 1031 couples to the main air pump 101, the air replenishing pump 20, the driving switch 102, and the air pressure sensor 149. The input control unit 1032 couples to the main control unit 1031 and to the input unit 107.

The structure of the main air pump 101 and the driving switch 102 will now be described with reference to FIGS. 4 through 8.

As best illustrated in FIGS. 4 through 8, the main air pump 101 includes a cover 108, an impeller 109, and a main motor 110. The cover 108, located in the accommodating chamber, couples to the housing 104 and divides the accommodating chamber of the housing 104 into an impeller chamber and a driving chamber. The impeller chamber extends between the housing 104 and the cover 108. The driving chamber is in fluid communication with an outer environment of the smart air pump 1. The cover 108 defines an inlet port 111 and an outlet port 143. The impeller 109 is located inside of the impeller chamber 108. The main motor 110 is located inside of the driving chamber and on the cover 108. The main motor 110 couples to the central control unit 103. A rotating shaft of the main motor 110 couples to the impeller 109 through the inlet port 111. The driving switch 102 couples to the outlet port 143.

The air pressure sensor 149 is located in the driving chamber and is in communication with the inflatable body via a pressure measuring pipe. One end of the pressure measuring pipe couples to the air pressure sensor 149, and the other end of the pressure measuring pipe couples to a pressure tap provided on the housing 104. The pressure tap is in communication with the inflatable body.

The housing 104 defines a second venting hole 123, and the second venting hole 123 is in communication with the inflatable body. A one-way valve 118 is located at the second venting hole 123 for regulating airflow through the second venting hole 123.

The driving switch 102 is located inside of the driving chamber. The driving switch 102 includes an actuator 1021 and an air passage switch 1022. According to an embodiment of the present invention, the actuator 1021 comprises a commutation motor 128. The actuator 1021 couples to the central control unit 103 for receiving a start signal sent by the central control unit 103 to activate the commutation motor 128. The air passage switch 1022 couples to the outlet port 143 of the cover 108 and is in communication with the first venting hole 106 of the panel 105 and with the second venting hole 123 of the housing 104. The actuator 1021 drives the air passage switch 1022 to initiate air passage switching wherein the air passage includes an inflation air passage configuration, a deflation air passage configuration, and a closed air passage configuration.

Figure 4:
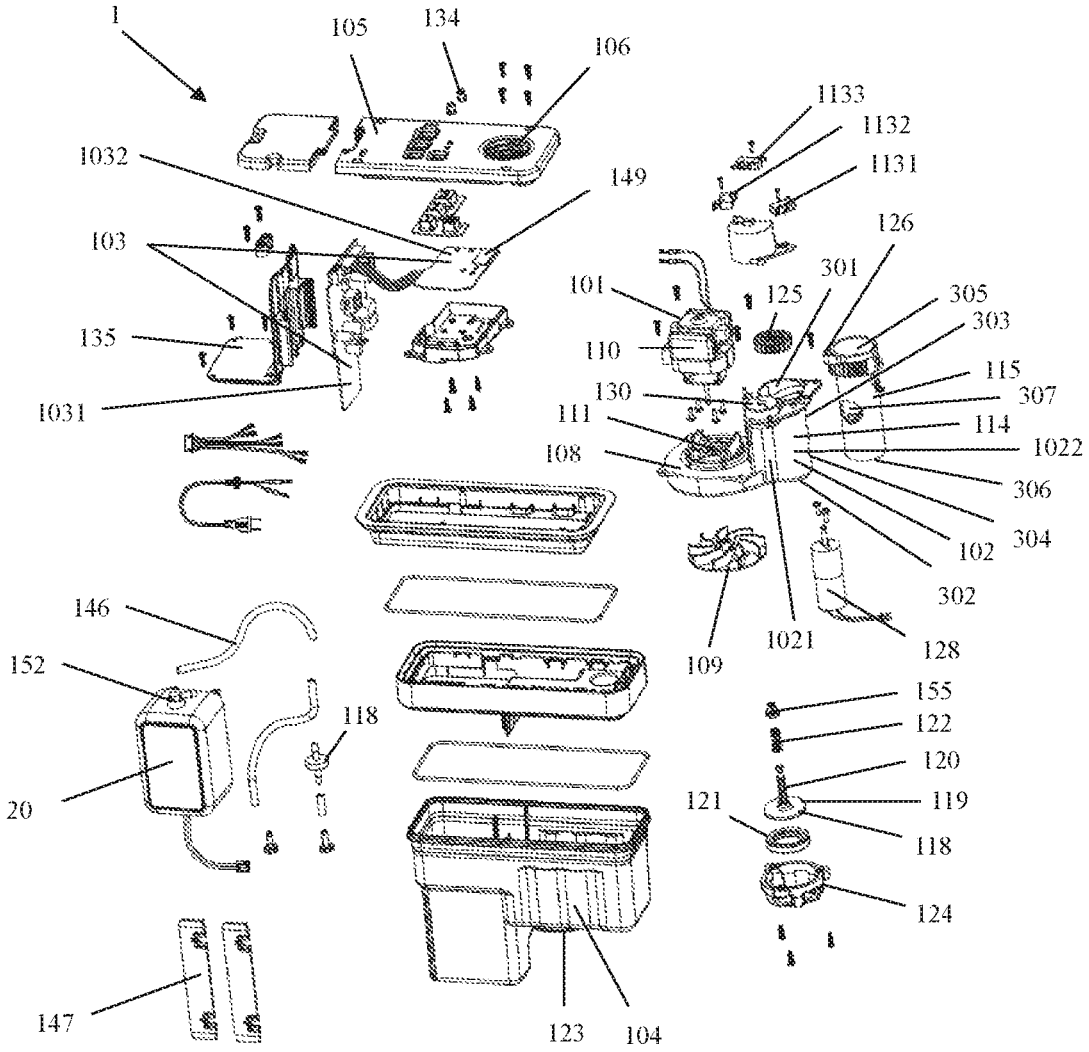
FIG. 4 is an exploded view of the smart air pump.
Figure 5:
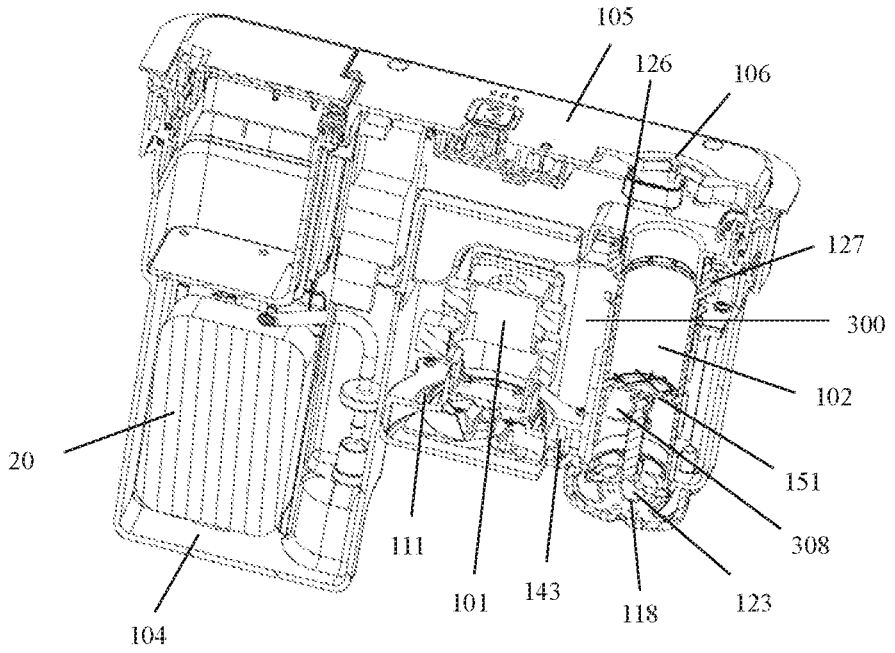
FIG. 5 is a cross-sectional perspective view of the smart air pump.

According to an embodiment of the present invention, the driving switch 102 includes at least one position signal generating device. The position signal generating device is located in the driving chamber and is electrically connected to the central control unit 103. The position signal generating device is coupled to and triggered by the air passage switch 1022 to generate a position signal sent to the central control unit 103. As shown in FIG. 4, the position signal generating device can further include a first signal generating device 1131, a second signal generating device 1132 and a third signal generating device 1133. The first signal generating device 1131 is configured to generate a position signal to the central control unit 103, in response to the air passage switch 1022 establishing the inflation air passage configuration. The second signal generating device 1132 is configured to generate a position signal to the central control unit 103, in response to the air passage switch 1022 establishing the deflation air passage configuration. The third signal generating device 1133 is configured to generate a position signal to the central control unit 103, in response to the air passage switch 1022 establishing the closed air passage configuration. It should be appreciated that these position signals may be displayed, for example, by the display unit.

The air passage switch 1022 includes an outer tube 114 and an inner tube 115. The outer tube 114 is in fluid communication with the inflatable body via the second venting hole 123 of the housing 104. The outer tube 114 couples to the cover 108 and is in fluid communication with the outlet port 143 of the cover 108. The inner tube (also referred to as a commutation core) 115 is rotatably fitted in the outer tube 114 and is also axially movable within the outer tube 114. A first end of the inner tube 115 is in fluid communication with the first venting hole 106 on the panel 105. The actuator 1021 starts air passage switching by driving the inner tube 115 to move axially and rotate inside of the outer tube 114.

As best illustrated in FIGS. 4-8, the outer tube 114 defines a first opening 301, a second opening 302, a third opening 303, a fourth opening 304, and an inlet channel 300. The first opening 301 is located at a first end of the outer tube 114 for receiving the inner tube 115. In other words, the inner tube 115 is slidably placed into the outer tube 114 through the first opening 301. The second opening 302 is located at a second end of the outer tube 114 and is in fluid communication with the inflatable body via the second venting hole 123. The third opening 303 is located on an outer tube wall of the outer tube 114. The third opening 303 is adjacent to the first end of the outer tube 114 and in fluid communication with the driving chamber. The fourth opening 304 is located on the outer tube wall of the outer tube 114. The fourth opening 304 is axially spaced apart from the third opening and adjacent to the second end of the outer tube 114. The fourth opening 304 is in fluid communication with the driving chamber. The inlet channel 300 is in fluid communication with the outlet port 143 of the cover 108.

Figure 6:
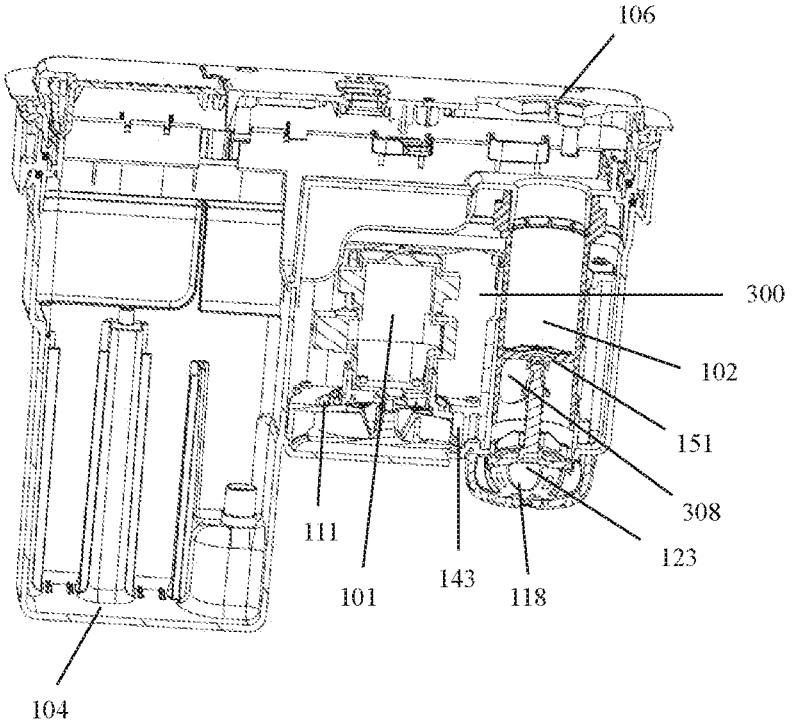
FIG. 6 is a cross-sectional view of the smart air pump in a stopped state.
Figure 7:
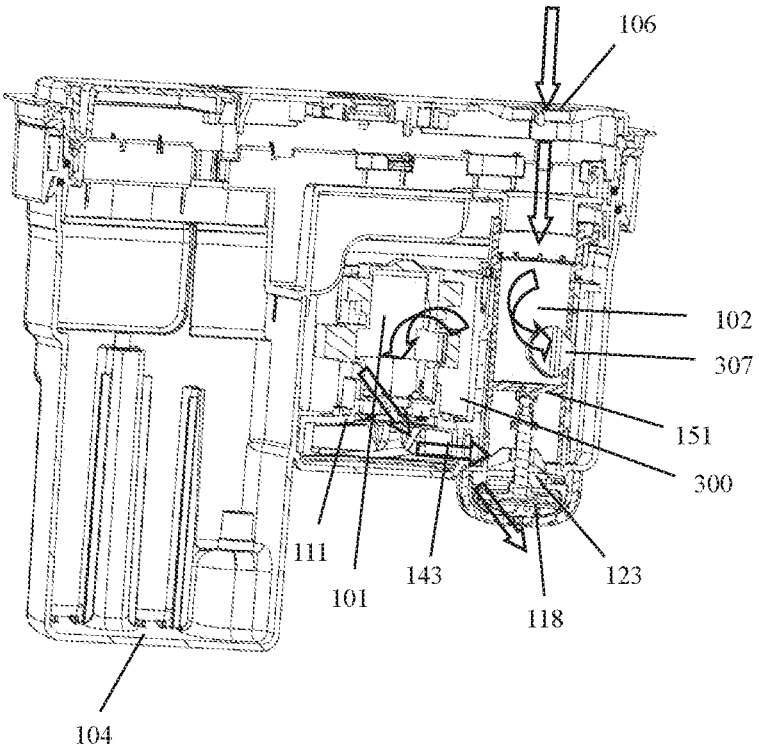
FIG. 7 is a cross-sectional view of the smart air pump in an inflation state.
Figure 8:
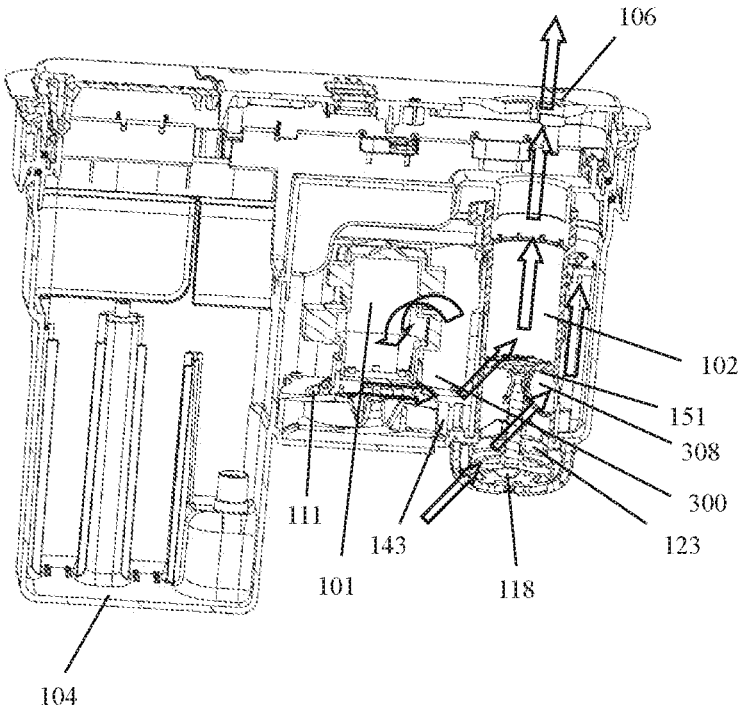
FIG. 8 is a cross-sectional view of the smart air pump in a deflation state.
Figure 9A:
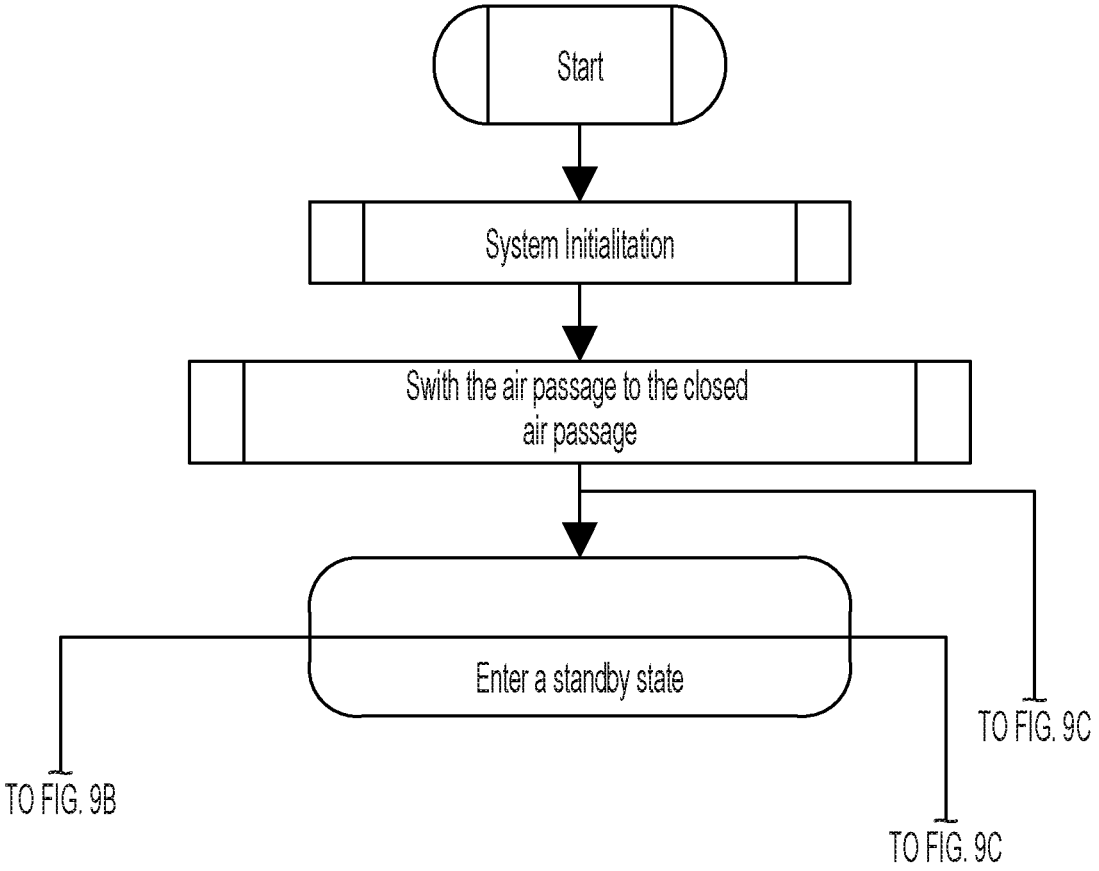
FIG. 9 is a flowchart view illustrating an operation process of the smart air pump constructed in accordance with one embodiment of the present invention.
Figure 9B:
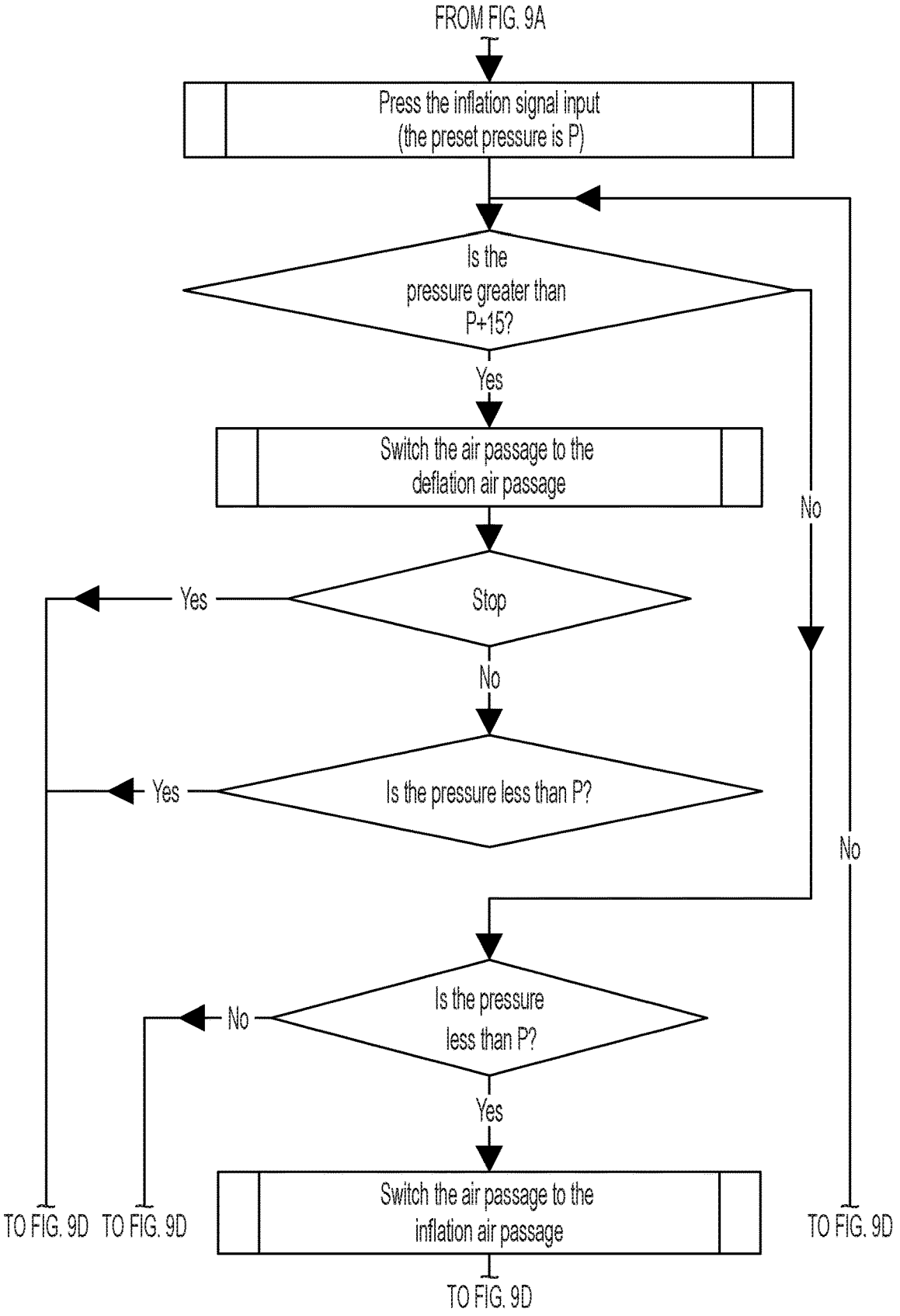
Figure 9C:
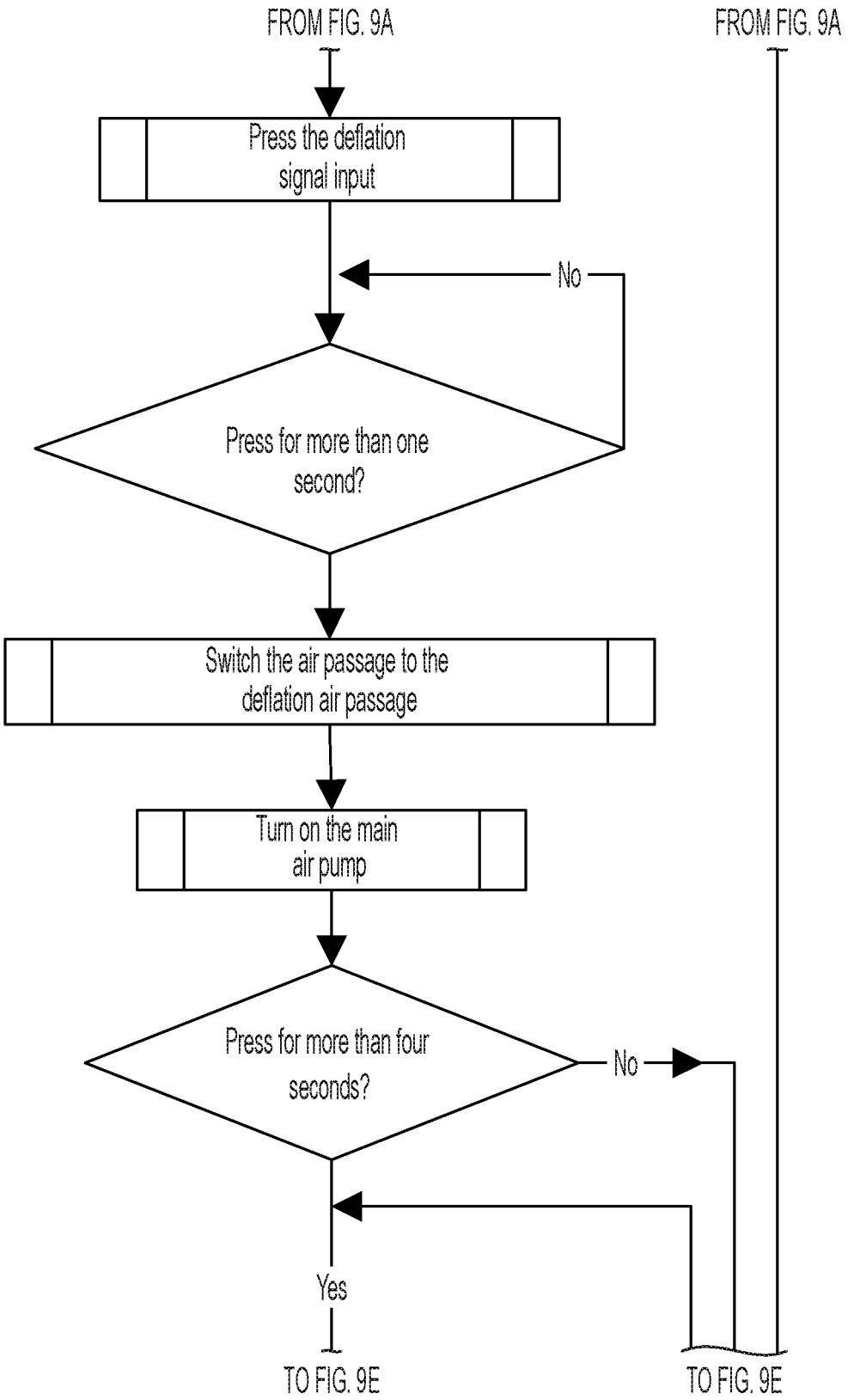
Figure 9D:
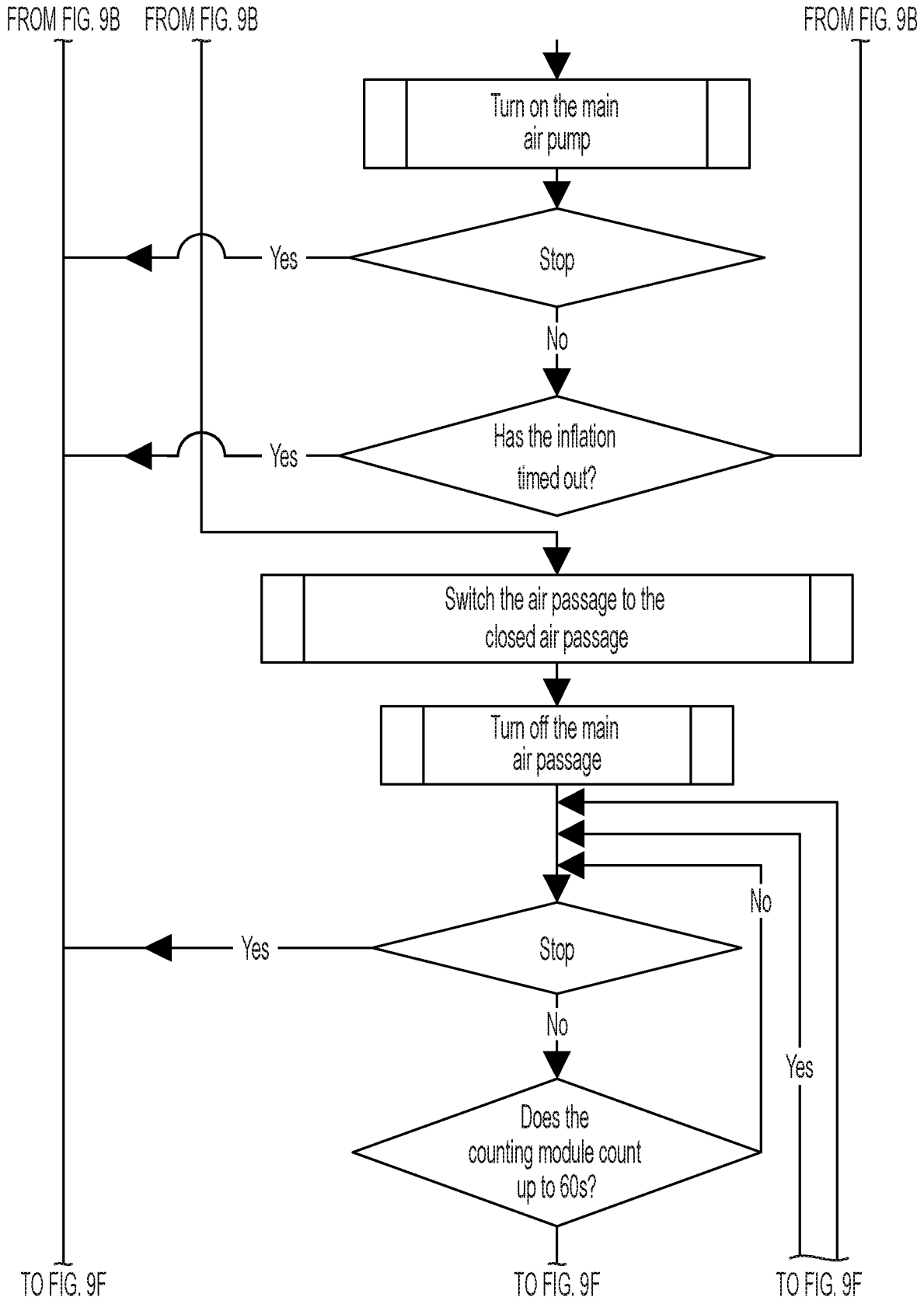
Figure 9E:
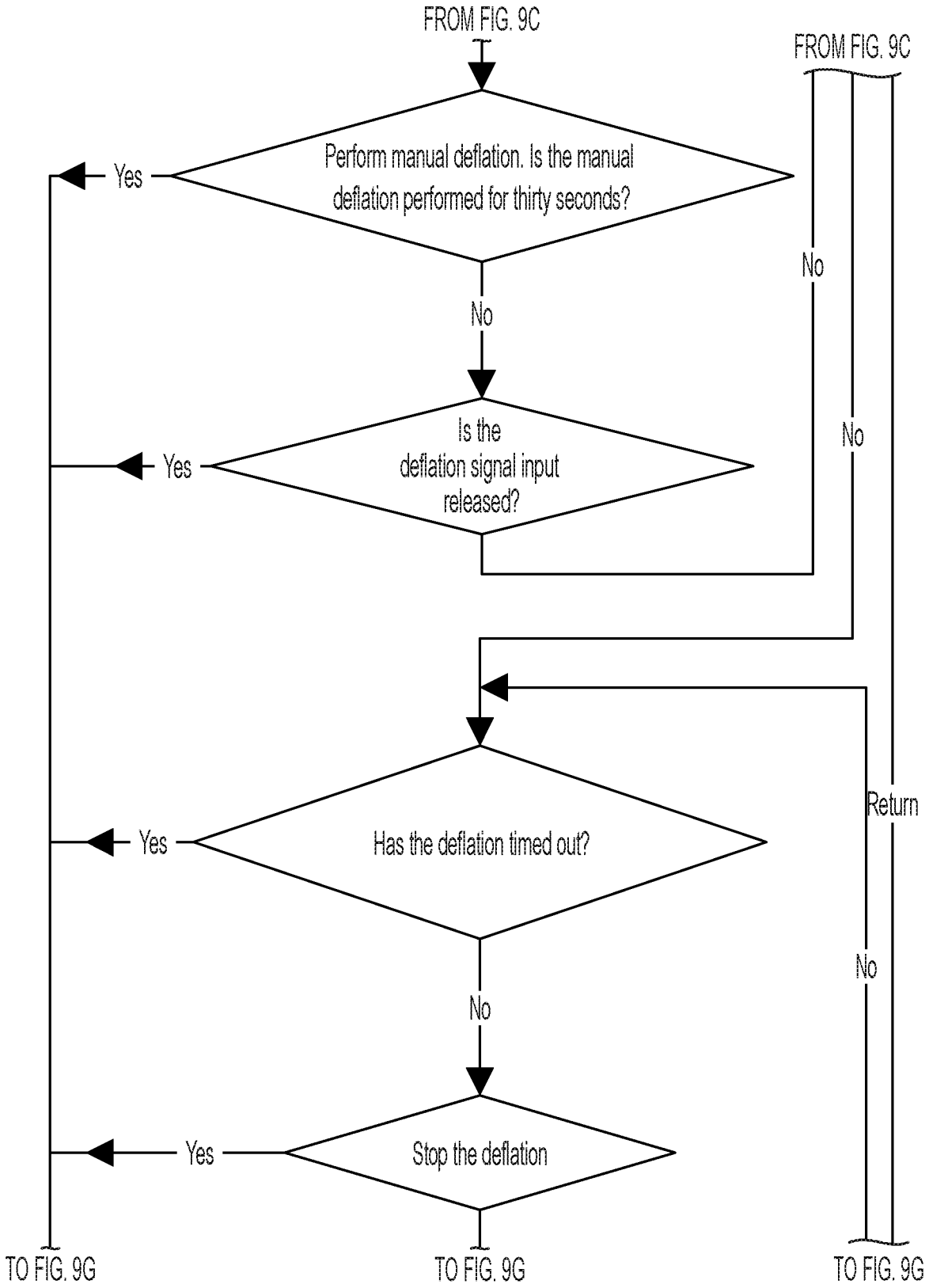
Figure 9F:
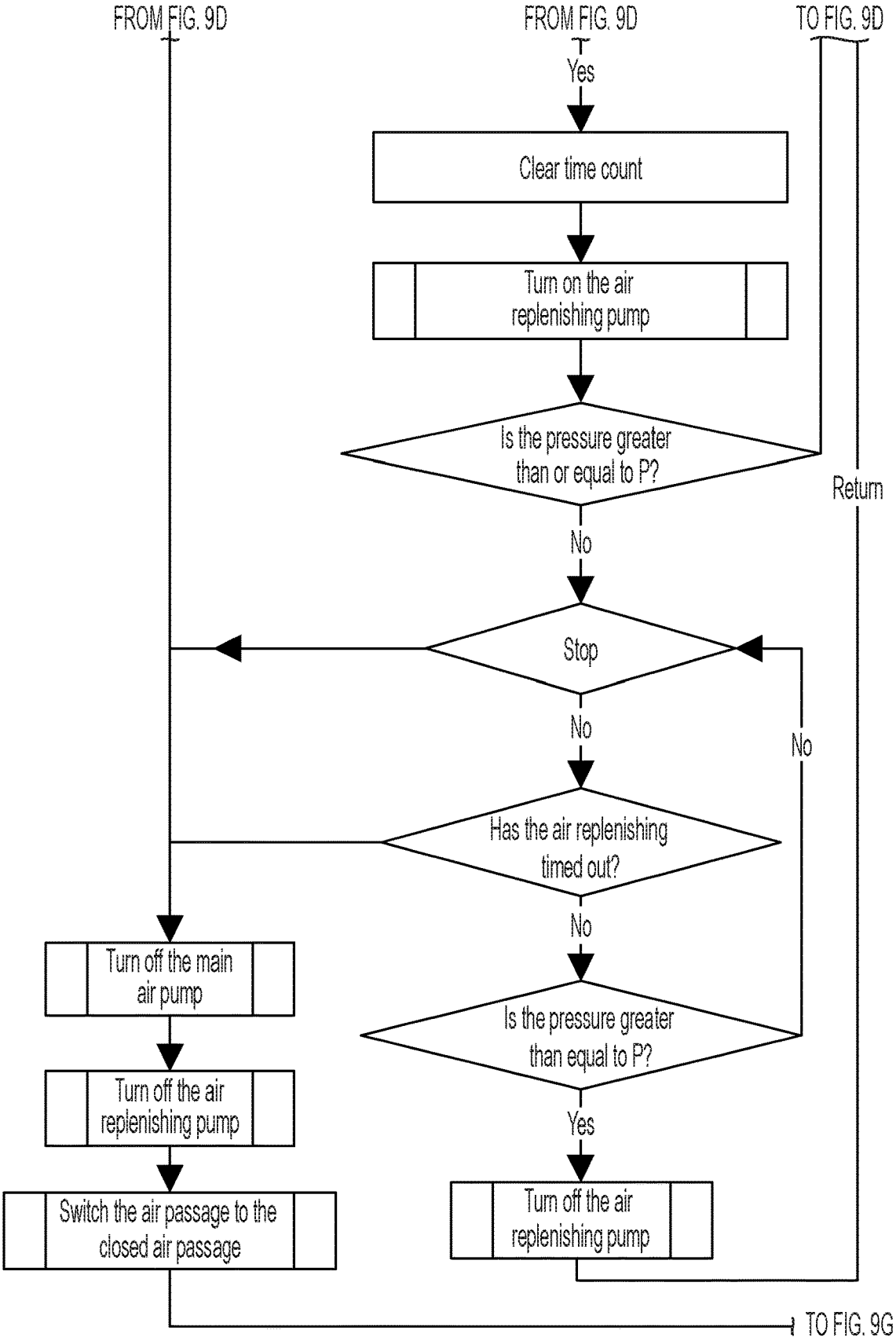
Figure 9G:
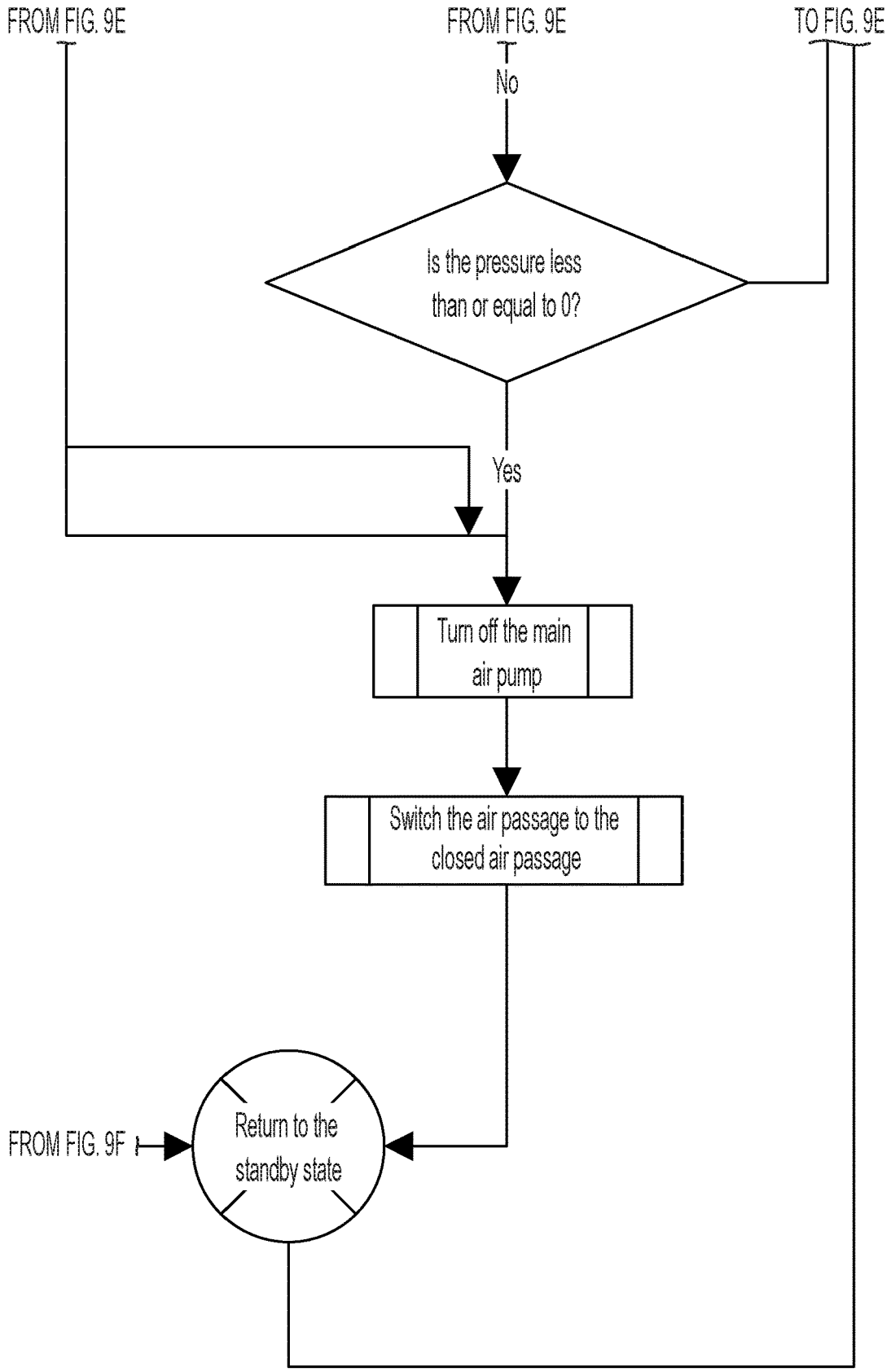
Figure 10:
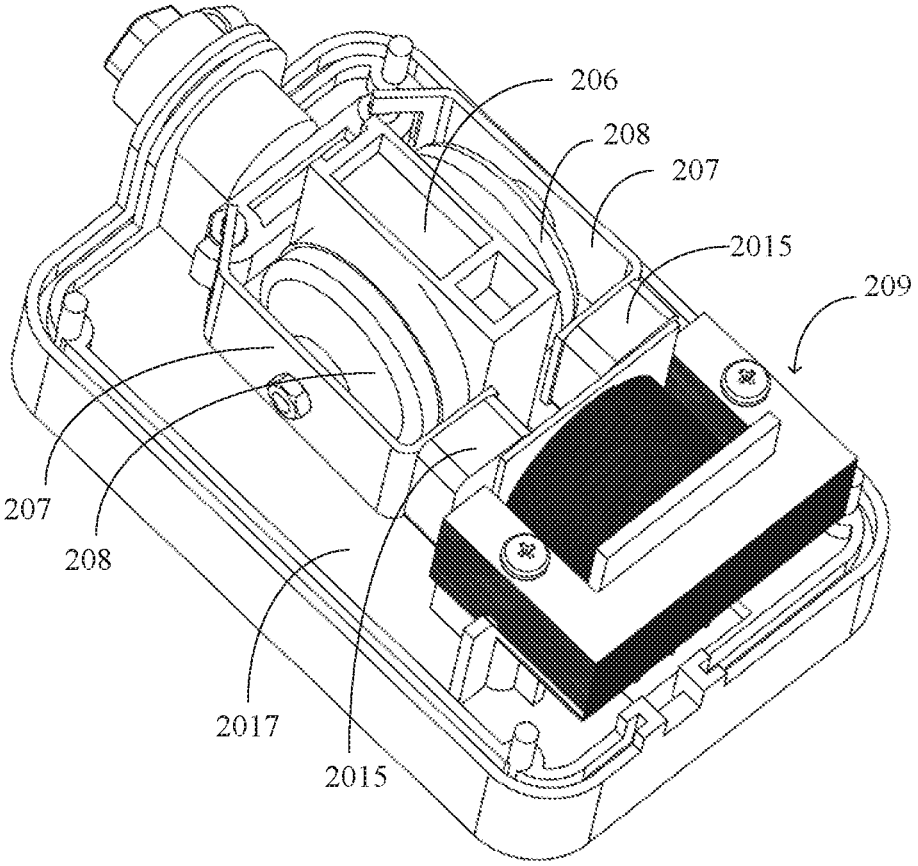
FIG. 10 is a perspective view of an air replenishing pump constructed in accordance with one embodiment of the present invention.
Figure 11:
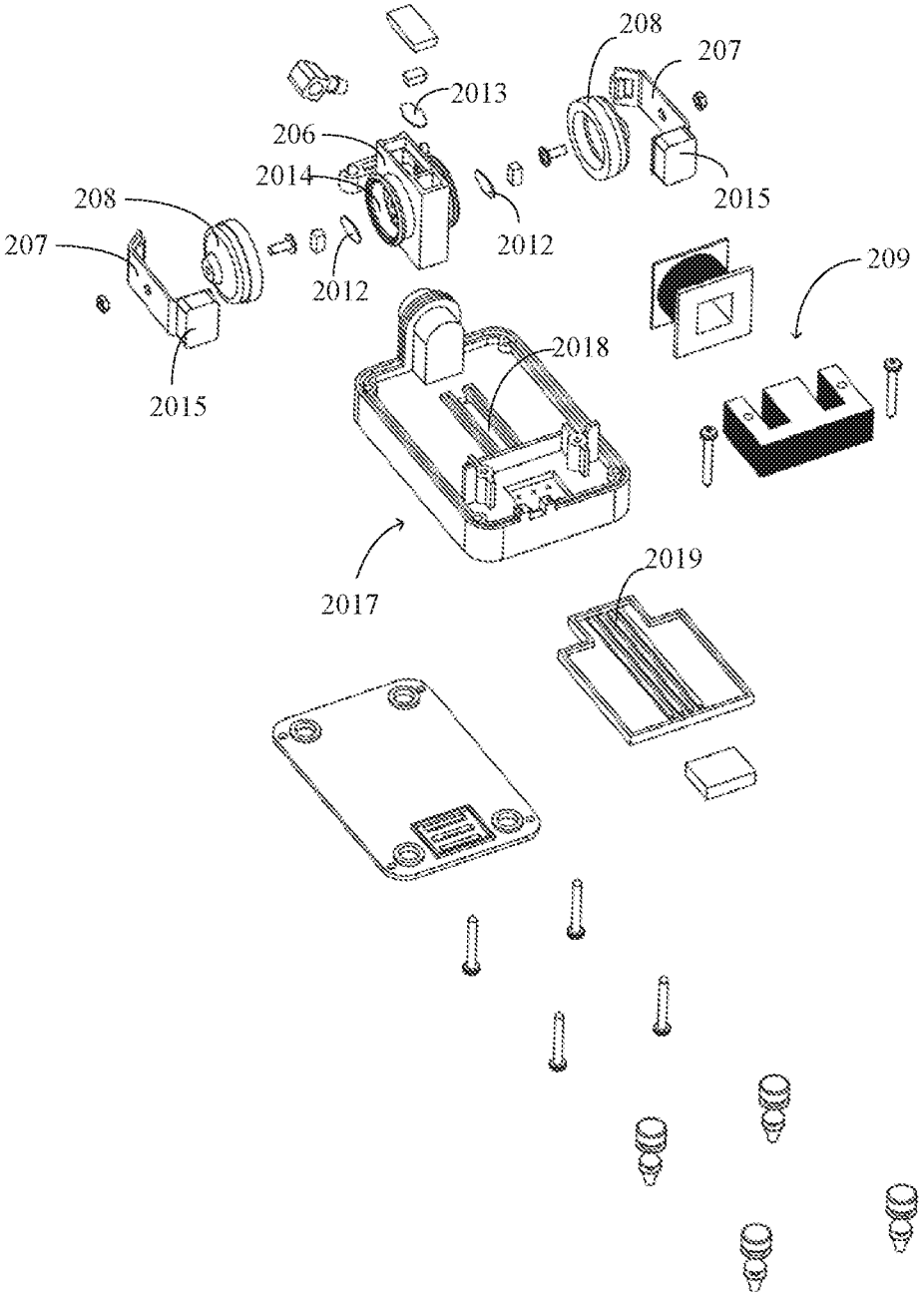
FIG. 11 is an exploded top view of the air replenishing pump.
Figure 12:
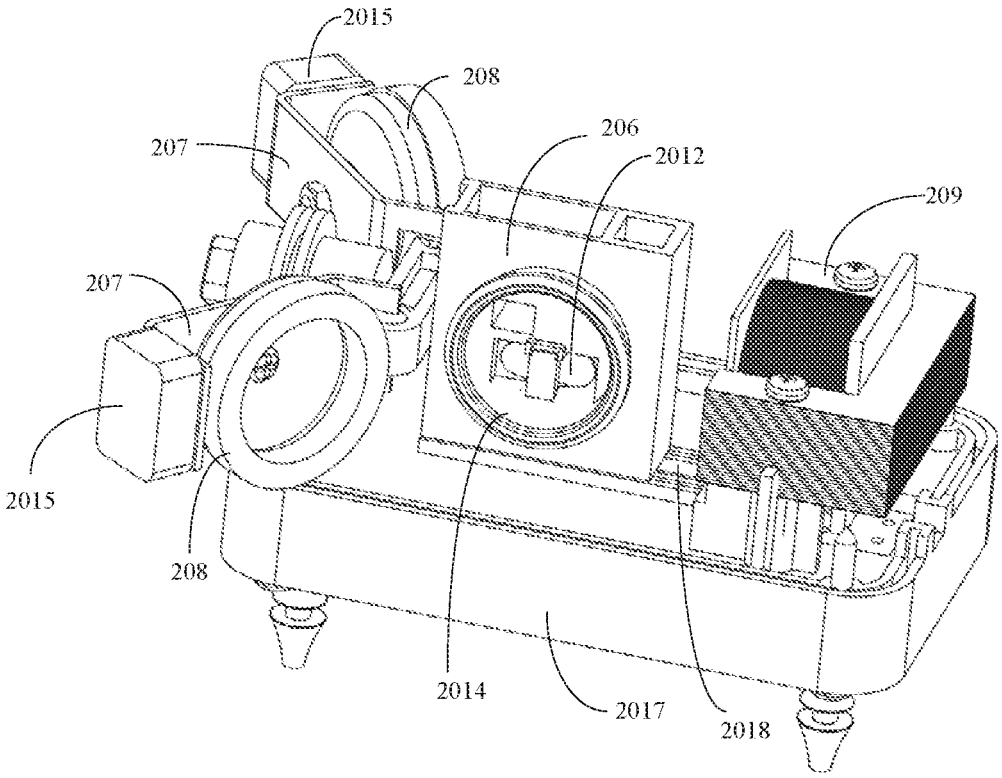
FIG. 12 is a perspective side view of the air replenishing pump.
Figure 13A:
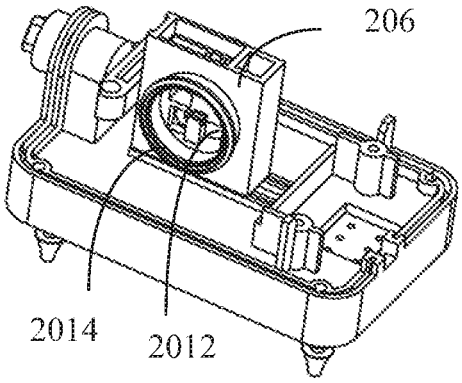
FIG. 13*a* is a perspective side view of the air replenishing pump, without cups.
Figure 13B:
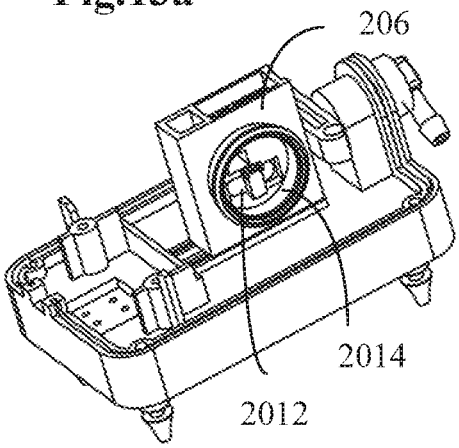
FIG. 13*b* is another perspective side view of the air replenishing pump, without cups.
Figure 13C:
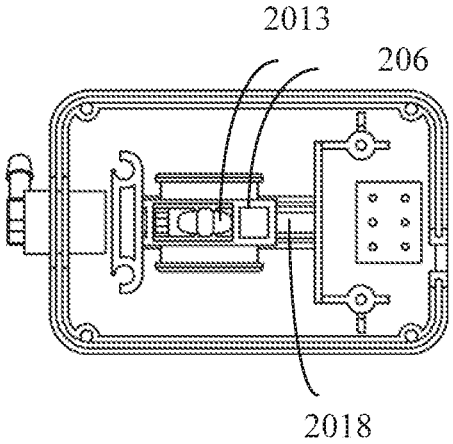
FIG. 13*c* is a top view of the air replenishing pump, without cups.
Figure 14:
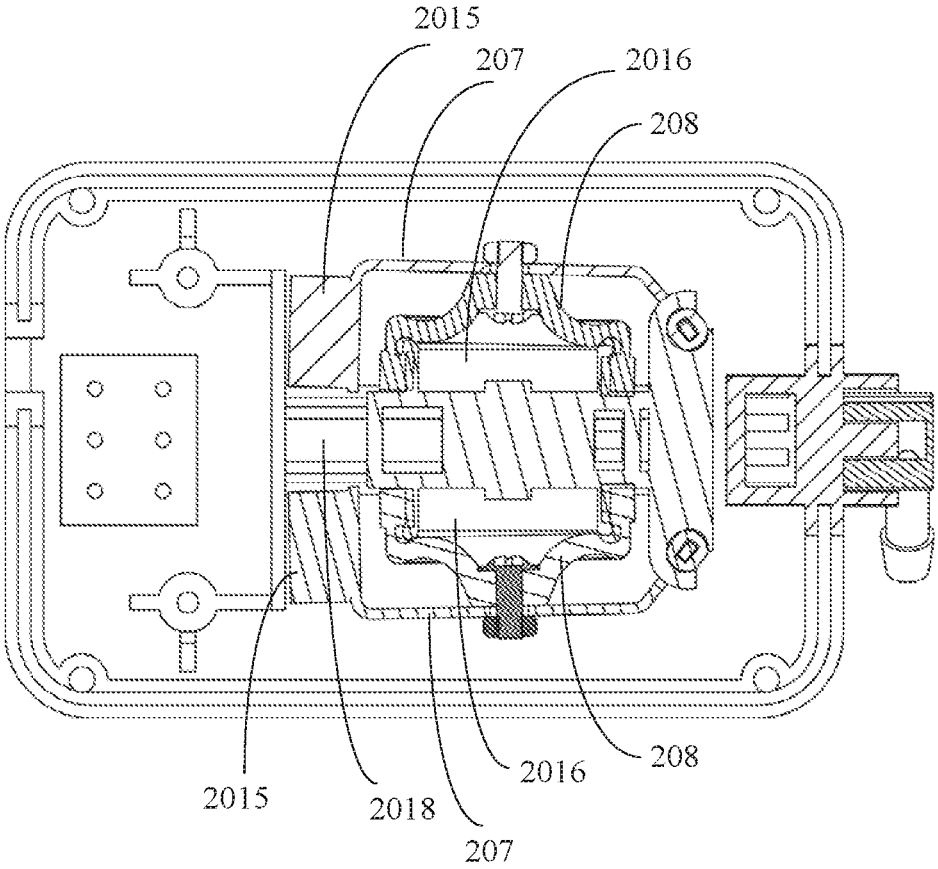
FIG. 14 is a cross-sectional view of the air replenishing pump.

The inner tube 115 defines a fifth opening 305, a sixth opening 306, a seventh opening 307, and an eighth opening 308. The fifth opening 305 is located at a first end of the inner tube 115 and is in fluid communication with the outer environment of the inflatable body. The sixth opening 306 is located at a second end of the inner tube 115 and is in fluid communication with the second venting hole 123. The seventh opening 307 is located an inner tube wall of the inner tube 115. The eighth opening 308 is located on the inner tube wall opposite of the seventh opening 307. A separator 151 is located inside the inner tube 115 dividing an interior of the inner tube 115 into two spaces, e.g. an upper space and a lower space, that are not in communication with one another. The seventh opening 307 and the eight opening 308 are provided on opposites sides of the separator 151. In other words, the separator 151 is located between the seventh opening 307 and the eighth opening 308. According to an embodiment of the present invention, the inner tube 115 is movably and partially sleeved outside of a venting tube. The venting tube is in communication with the first venting hole 106, through the fifth opening 305. As best shown in FIG. 7, as the inner tube 115 rotates within the outer tube 114, when the third opening 303 of the outer tube 114 is in alignment with the seventh opening 307, and the eighth opening 308 is in alignment with the inlet channel 300, the air passage switch 1022 establishes the inflation air passage configuration (the direction of the inflation air flow is indicated by the arrows). As best shown in FIG. 8, as the inner tube 115 rotates within the outer tube 114, when the fourth opening 304 is in alignment with the eighth opening 308, and the seventh opening 307 is in alignment with the inlet channel 300, the air passage switch 1022 establishes the deflation air passage configuration (the direction of the deflation air flow is indicated by the arrows). As best shown in FIG. 6, when the seventh opening 307 is not in alignment with the third opening 303 and the inlet channel 300 and the eighth opening 308 are not in alignment with the fourth opening 304 and the inlet channel 300, the air passage switch 1022 establishes the closed air passage configuration (i.e. a stopped state).

As best illustrated in FIGS. 4-8, the inner tube 115 can include a first transmission gear 125, a first bump 126, and a second bump 127. The first transmission gear 125 is located at the outside of the first end of the inner tube 115. The first bump 126 is located at the outside of the first end of the inner tube 115 and extends radially outwardly from the first end of the inner tube 115 for engaging the third signal generating device 1133 to generate a position signal in response to a rotation movement of the inner tube 115. The second bump 127 is located opposite of the first bump 126 at the outside of the first end of the inner tube 115. The second bump 127 extends radially outwardly from the inner tube 115 for engaging the first signal generating device 1131 or the second signal generating device 1132 to generate a position signal in response to a rotational movement of the inner tube 115.

As also shown in FIG. 4, the actuator 1021 can include the commutation motor 128, a second transmission gear (not shown), and a motor frame 130. The second transmission gear is coupled to a rotating shaft of the commutation motor 128 and is in mesh engagement with the first transmission gear 125. The motor frame 130 couples to the outer tube 114, and the commutation motor 128 couples to the motor frame 130. The commutation motor 128 drives the first transmission gear 125 via the second transmission gear to rotate the inner tube 115 within the outer tube 114.

According to an embodiment of the present invention, the outer tube 114 may include a slideway, and the inner tube 115 may correspondingly include a sliding block (the slideway and the sliding block are not shown). The slideway is located on the tube wall of the outer tube 114 and has an arc shape with the center of the arc shape higher than both ends thereof. The sliding block is located on the outer surface of the inner tube 115. The sliding block is configured to be slidable within the slideway, such that the inner tube 115 is axially movable while being rotated.

When the inner tube 115 is rotated, the sliding block moves towards an first end of the slideway. At the same time, the inner tube 115 is axially moved toward the second venting hole 123. Accordingly, the third opening 303 is in alignment with the seventh opening 307, and the eighth opening 308 is in alignment with the inlet channel 300. At this time, the air passage switch 1022 establishes the inflation air passage configuration, and the inner tube 115 pushes the one-way valve 118 open, as shown in FIG. 7.

When the inner tube 115 is rotated, the sliding block moves toward a second end of the slideway. At the same time, the inner tube 115 is axially moved toward the second venting hole 123. Accordingly, the fourth opening 304 is in alignment with the eighth opening 308, and the seventh opening 307 is in alignment with the inlet channel 300. At this time, the air passage switch 1022 establishes the deflation air passage configuration, and the inner tube 115 pushes the one-way valve 118 open, as shown in FIG. 8.

When the sliding block is moved to an arc-shaped bottom at a center of the slideway, the inner tube 115 is axially moved away from the second venting hole 123, thereby releasing the force applied to the one-way valve 118 by the inner tube 115. Accordingly, the air passage switch 1022 establishes the closed air passage configuration, and the one-way valve 118 is closed to prevent fluid communication between the inflatable body and the outer environment of the inflatable body, as shown in FIG. 6.

As shown in FIG. 4, the one-way valve 118 may include a valve plate 119, a valve rod 120, a supporting frame (not shown), and a spring 122. The valve plate 119 includes a sealing ring 121 for providing a sealing engagement to the second venting hole 123. The valve rod 120 couples to the valve plate 119, and an end of the valve rod 120 includes a limiting member 155. The supporting frame is located in the second venting hole 123, and the valve rod 120 is located in a through hole of the supporting frame. The valve rod 120 is movable in an axial direction inside the through hole of the supporting frame. The spring 122 is sleeved outside of the valve rod 120 and located between the limiting member 155 and the supporting frame for biasing the valve plate 119 against the second venting hole 123 to cover the second venting hole 123.

As the inner tube 115 moves axially toward the second venting hole 123, the separator 151 of the inner tube 115 engages and pushes the valve rod 120, thereby moving the valve plate 119 axially to open the second venting hole 123. As the inner tube 115 moves axially away from the second venting hole 123, the force applied to the one-way valve 118 by the separator 151 of the inner tube 115 is released and the valve plate 119 is biased against the second venting hole 123 under a spring force of the spring 122. According to an embodiment of the present invention, the housing 104 includes a protective cover 124 located adjacent to the second end of the inner tube 115. The protective cover 124 couples to the housing 104 for protecting the one-way valve 118.

The air replenishing pump 20 couples to the central control unit 103 and defines a second inlet port (not shown) and a second outlet port 152. The second inlet port is configured to allow the air in the space outside of the smart electric air pump to enter the interior of the air replenishing pump 20. The second outlet port 152 is in communication with the inflatable body. The central control unit 103 comprises a time control module configured to initiate periodic replenishment of air to the inflatable body. The air replenishing pump 20 includes a mounting frame 147 for coupling the air replenishing pump 20 to the housing 104.

According to an embodiment of the present invention, the time control module includes a setting module for setting a cycle time and a counting module for counting the cycle time. After the air pressure inside of the inflatable product reaches the preset inflation pressure and the cycle time is set by the setting module and reached by the counting module, the central control unit 103 sends a start signal to the air replenishing pump 20 to initiate air replenishing. When the air pressure inside of the inflatable product, as detected by the air pressure sensor 149, is greater than or equal to a preset air pressure, the air replenishing pump 20 is stopped. The principle of the air replenishing operation is as follows. When the counting module counts to the preset cycle time, the central control unit 103 activates the air replenishing pump 20 to start and perform the air replenishing operation. At the same time, the air pressure sensor 149 detects the air pressure inside of the inflatable body. When the air pressure inside of the inflatable product is greater than or equal to the preset air pressure set by operating the first inflation signal input 1071, the second inflation signal input 1072, or the third inflation signal input 1073, the central control unit 103 triggers the air replenishing pump 20 to stop. Otherwise, the air replenishing pump 20 continues to perform the air replenishing operation, until the preset air pressure is reached. Accordingly, the central control unit 103 triggers the air replenishing pump 20 to stop. After the air replenishing pump 20 stops, the counting module recounts the cycle time to trigger the next cycle of the air replenishing operation. The air replenishing operation continues cycling in this manner.

As best illustrated in FIG. 4, the air replenishing pump 20 is located inside of the driving chamber of the housing 104 wherein the air replenishing pump 20 and the main air pump 101 are separated by a bracket 135 provided in the housing 104. The second outlet port 152 is in communication with the inflatable body via an air replenishing tube 146 wherein one end of the air replenishing tube 146 couples to the second outlet port 152, and the other end of the air replenishing tube 146 couples to an air replenishing port provided on the housing 104. According to an embodiment of the present invention, the air replenishing pump 20 can include the one-way valve 118 coupled to the air replenishing pump 20 for preventing air inside of the inflatable body from flowing to the outer environment after the air replenishing pump 20 is stopped.

The air replenishing pump 20 constructed in accordance with an embodiment of the present invention is shown in FIGS. 10-15*b*. The air replenishing pump 20 includes a core 206, at least one pivot arm 207, and an electromagnetic device 209. According to an embodiment of the present invention, the at least one pivot arm 207 includes a pair of pivot arms 207. The pair of pivot arms 207 are provided on opposing sides of the core 206. The core 206 includes an inlet port 2010, an outlet port 2011, a first one-way valve 2012, a second one-way valve 2013, and a core opening 2014. Each pivot arm 207 includes a cup 208 and a magnet 2015 coupled thereto. The cup 208 covers the core opening 2014 of the core 206 to define an air chamber 2016. The electromagnetic device 209 is configured to generate magnetic flux, causing the magnet 2015 and the at least one pivot arm 207 to move, thereby causing the cup to compress and expand the air chamber 2016. When the cup 208 expands the space of the air chamber 2016, the air replenishing pump 20 draws air from the outer environment of the inflatable body into the air chamber 2016 through the first one-way valve 2012 disposed at the inlet port 2010. When the cup 208 compresses the air chamber 2016, the air replenishing pump 20 discharges air from the air chamber 2016 through the second one-way valve 2013 disposed at the outlet port 2011. It should be understood that the air replenishing pump 20 may be provided with only one pivot arm. The first one-way valve 2012 and the second one-way valve 2013 are in the form of one-way valve plates, according an embodiment of the present invention.

According to an embodiment of the present invention, the air replenishing pump 20 includes a base 2017. The core 206 is mounted on the base 2017 to define the inlet port 2010 and the outlet port 2011. The base 2017 includes a first groove 2018, defining a first air passage for directing air from the outer environment of the inflatable body to the inlet port 2010 of the core 206. The base 2017 also includes a second groove 2019, defining a second air passage for directing air in the air chambers 2016 from the outlet port 2011 to the outer environment of the inflatable body. The first groove 2018 and the second groove 2019 are independent of each other. Moreover, the intake and discharge of air are staggered in time and do not occur simultaneously.

Figure 15A:
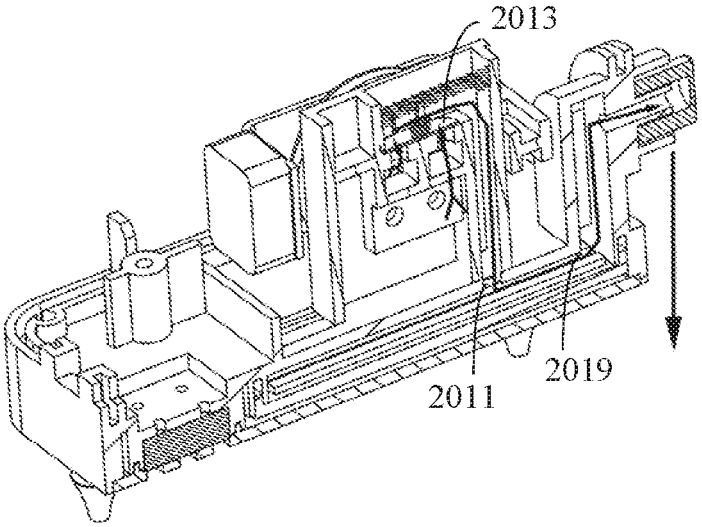
FIG. 15*a* is a cross-sectional perspective view of the air replenishing pump wherein the air replenishing pump is providing air to an inflatable body.
Figure 15B:
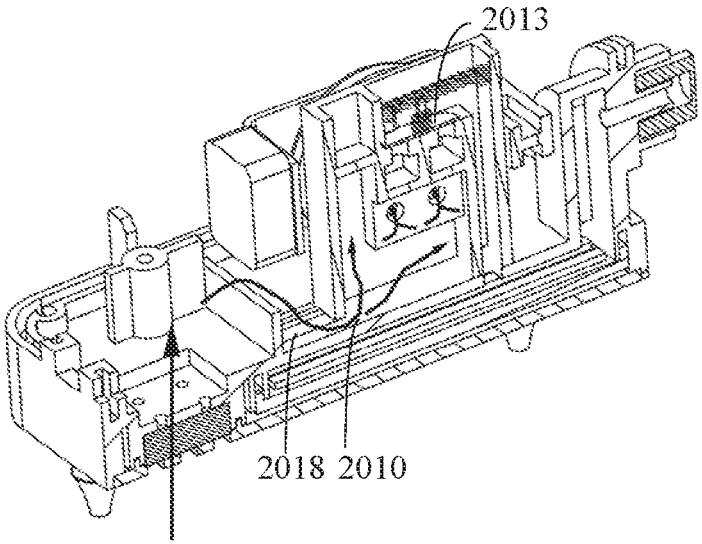
FIG. 15*b* is a cross-sectional perspective view of the air replenishing pump wherein the air replenishing pump is withdrawing air from the inflatable body.

According to an embodiment of the present invention, the two cups 208 form two air chambers 2016 with the core 206. Each of the air chambers 2016 includes a first one-way valve 2012 and a second one-way valve 2013. As illustrated in FIG. 15*a* wherein the direction of air flow is indicated by the arrows, when the air chamber 2016 compresses, the first one-way valve 2012 prevents air from entering the first air passage from the air chamber 2016 through the inlet port 2010, and the second one-way valve 2013 allows air to enter the second air passage from the air chamber 2016 through the outlet port 2011 and then be discharged to provide air replenishing to the inflatable body. As illustrated in FIG. 15*b* wherein the direction of air flow is indicated by the arrows, when the space of the air chamber 2016 expands, the second one-way valve 2013 prevents air from entering the air chamber 2016 from the second air passage through the outlet port 2011, and the first one-way valve 2012 allows air to enter the air chamber 2016 from the first air passage through the inlet port 2010, such that the air chamber 2016 can receive air from the first air passage. During this process, air from the outer environment of the inflatable body is provided to the air replenishing pump 20.

One period of compressing and one period of expanding are considered as one operating cycle. The operating frequency depends on the frequency of the alternating current in each country. For example, with an alternating current having a frequency of 50 Hz, the cup 208 compresses and expands the space of the air chamber 50 times per second, and the air replenishing pump 20 performs air replenishing operation 50 times per second. With an alternating current having a frequency of 60 Hz, the cup 208 compresses and expands the space of the air chamber 60 times per second, and the air replenishing pump 20 performs air replenishing operation 60 times per second.

The specific operation mode of the smart electric air pump 1 according to an embodiment of the present invention will be described below with reference to the flow chart in FIG. 9.

First, after initializing the smart electric air pump 1, the operational process first switches to the closed air passage configuration, thereby allowing the entire smart air pump 1 to enter a standby state.

Then, in the event that a user presses one of the inflation signal inputs, e.g. the first inflation signal input 1071, the second inflation signal input 1072 or the third inflation signal input 1073, assuming that the initially preset inflation pressure is P, the air pressure sensor 149 determines whether current air pressure inside the inflatable body is greater than P+15, for example. In the event that the air pressure inside inflatable body is greater than P+15, the air passage switch 1022 is moved to establish the deflation air passage configuration to perform deflation. During this process, if an input for stopping deflation is received or the detected pressure is less than P, the air passage switch 1022 is moved to the closed air passage configuration. If the air pressure inside of the inflatable body is less than P+15, and it is detected whether current air pressure inside the inflatable product is less than P, the air passage switch 1022 is moved to establish the inflation air passage configuration and the main air pump 101 is activated to perform inflation. If the air pressure inside the inflatable body is not less than P, there is no need for inflation and the air passage switch 1022 is moved to establish the closed air passage configuration. During the inflation process, it is simultaneously detected whether the user gives an input for stopping the inflation and whether the inflation has timed out. When the above condition is detected, the main air pump 101 and the air replenishing pump 20 are subsequently deactivated and the air passage switch 1022 is moved to establish the closed air passage configuration, and the smart air pump 1 enters the standby state. After the inflatable product is inflated by the main air pump 101, and the air pressure inside the inflatable product reaches the pressure P, the air passage switch 1022 is moved to establish the closed air passage configuration, and then the main air pump 101 becomes deactivated. Accordingly, the counting module of the time control module of the central control unit 103 begins to count time. When the counting module counts to the cycle time preset by the setting module of the time control module (as illustrated in FIG. 9, the cycle time can be sixty seconds, and generally, the cycle time may be set to be any value greater than or equal to thirty seconds, for example, five minutes, ten minutes, thirty minutes and one hour, etc.), the counting module is stopped and the counted time is cleared. Then, the air replenishing pump 13 is activated to provide air replenishing to the inflatable body via an air replenishing process. If the air pressure sensor 149 detects that the air pressure inside of the inflatable body is greater than or equal to P, the air replenishing pump 20 is deactivated. Otherwise, the air replenishing pump 20 continues the air replenishing process, until the air pressure inside the inflatable product is greater than or equal to P. After the air replenishing pump 20 is stopped, the counting module of the time control module of the central control unit 103 restarts to count time to repeatedly initiate the air replenishing process. During the air replenishing process, it is simultaneously detected whether the user gives an input for stopping the air replenishing and whether the air replenishing has timed out. When the above condition is detected, the smart electric air pump returns to the aforementioned standby state.

In the event that a user presses the deflation signal input 1074 of the input unit 107, it is first determined whether the deflation signal input 1074 is pressed for more than one second (preset, as an example preset value). If the deflation signal input 1074 is pressed for more than one second, the air passage switch 1022 is moved to the deflation air passage configuration, and then the main air pump 101 is turned on to perform automatic deflation. If it is determined that the deflation signal input 1074 is pressed for more than four seconds (preset, again as an example preset value), a manual deflation mode can be entered, and further, it is simultaneously determined whether the manual deflation is performed for thirty seconds or whether the deflation signal input 1074 is released. When it is detected that the manual deflation is performed for thirty seconds or the deflation signal input 1074 is released, the deflation is stopped (that is, the main air pump 101 is turned off and the air passage is switched to the closed air passage configuration). During automatic deflation, if it is detected that the user gives an input for stopping the deflation or the deflation has timed out, the main air pump 101 is turned off and the air passage switch 1022 is moved to the closed air passage configuration, and then the smart air pump 1 returns to the standby state. In addition, during automatic deflation, it is detected in real time by the air pressure sensor 149 whether the air pressure inside the inflatable product is less than or equal to 0. If it is determined that the air pressure inside the inflatable body is less than or equal to 0, the deflation is directly stopped, and the entire system returns to the aforementioned standby state.

The technical content and features of the present invention have been disclosed herein. However, it should be understood that those skilled in the art can make various variations and improvements to the concepts disclosed herein under the inventive idea of the present disclosure, and all these variations and improvements belong to the scope of protection of the present invention.

The description for the above embodiments is illustrative and not restrictive, and the scope of protection of the present invention is determined by the claims.

What is claimed is:

1. A smart air pump for an inflatable body, the smart air pump comprising:

a housing defining an accommodating chamber;

a main air pump located in the accommodating chamber and configured to inflate or discharge air from the inflatable body, the main air pump comprising:

a cover defining a first inlet port and a first outlet port, the cover dividing the accommodating chamber into an impeller chamber extending between the housing and the cover and a driving chamber in fluid communication with an outer environment;

an air replenishing pump located in the accommodating chamber and adjacent to the main air pump, the air replenishing pump comprising:

a base, a core coupled to the base, the core defining a second inlet port, a second outlet port, and a core opening, at least one pivot arm, a magnet coupled to the at least one pivot arm, a cup coupled to the at least one pivot arm and to the core, the cup covering the core opening to thereby define an air chamber, and an electromagnetic device configured to generate magnetic flux causing the magnet and the at least one pivot arm to move, thereby causing the cup to compress and expand the air chamber;

wherein the base defines a first groove and a second groove, the first groove being in fluid communication with the second inlet port to thereby establish a first air passage for directing air into said air chamber via the second inlet port, and the second groove being in fluid communication with the second outlet port for directing air to the outer environment, a driving switch located in the driving chamber, connected to the main air pump, and configured to perform air passage switching; and a central control unit located in the driving chamber and electrically connected to the main air pump, the air replenishing pump and the driving switch, the central control unit comprising:

a time control module configured to initiate periodic replenishment of air to the inflatable body, the time control module comprising: a setting module for setting a cycle time, and a counting module for counting said cycle time.

2. The smart air pump according to claim 1, wherein the cycle time is greater than or equal to thirty seconds.

3. The smart air pump according to claim 2, wherein the cycle time is one of sixty seconds, five minutes, ten minutes, thirty minutes, and one hour.

4. The smart air pump according to claim 1, wherein after activating an inflation function of the smart air pump and deactivating an inflation function of said main air pump, said counting module begins counting for said cycle time and when said counting reaches an end of said cycle time, said air replenishing pump begins to replenish air until an air pressure inside the inflatable body is greater than or equal to a preset air pressure.

5. The smart air pump according to claim 4, wherein the counting module resets upon reaching said end of the cycle time.

6. The smart air pump according to claim 1, wherein the driving switch comprises:

an actuator in electrical communication with the central control unit and configured to activate in response to receiving a start signal from the central control unit; and an air passage switch in fluid communication with the first outlet port and the outer environment, the air passage switch being coupled to the actuator such that the actuator moves the air passage switch to establish one of an inflation air passage configuration, a deflation air passage configuration, and a closed air passage configuration.

7. The smart air pump according to claim 6, wherein the actuator comprises a commutation motor.

8. The smart air pump according to claim 6, wherein the driving switch comprises at least one position signal generator located in the driving chamber, the at least one position signal generator being coupled to the air passage switch and in electrical communication with the central control unit.

9. The smart air pump according to claim 8, wherein the at least one position signal generator comprises:

a first signal generator configured to generate and send a position signal to the central control unit in response to the air passage switch establishing the inflation air passage configuration;

a second signal generator configured to generate and send a position signal to the central control unit in response to the air passage switch establishing the deflation air passage configuration; and a third signal generator configured to generate and send a position signal to the central control unit in response to the air passage switch establishing the closed air passage configuration.

10. The smart air pump according to claim 6, wherein the air passage switch comprises:

an outer tube in fluid communication with the inflatable body and the first outlet port;

an inner tube rotatable and axially movable within the outer tube and in fluid communication with the outer environment.

11. The smart air pump according to claim 10, wherein the outer tube defines:

a first opening located at a first end of the outer tube for receiving the inner tube;

a second opening located at a second end of the outer tube, the second opening being in fluid communication with the inflatable body;

a third opening located on an outer tube wall, the third opening being adjacent to the first end of the outer tube and in fluid communication with the driving chamber;

a fourth opening located on the outer tube wall, the fourth opening being axially spaced apart from the third opening and adjacent to the second end of the outer tube, the fourth opening being in fluid communication with the driving chamber; and an inlet channel connected to the outlet port.

12. The smart air pump according to claim 11, wherein the inner tube defines:

a fifth opening located at a first end of the inner tube, the fifth opening being in fluid communication with the outer environment;

a sixth opening located at a second end of the inner tube and in fluid communication with the inflatable body;

a seventh opening located on an inner tube wall and adjacent to the first end of the inner tube;

an eighth opening located on the inner tube wall, opposite of the seventh opening and adjacent to the second end of the inner tube; and a separator located in the inner tube and dividing an interior of the inner tube into two spaces wherein the seventh opening and the eighth opening are provided on opposite sides of the separator.

13. The smart air pump according to claim 1, wherein, in response to the cup expanding the air chamber, the air replenishing pump draws air into the air chamber through a first one-way valve located at the first inlet port; and wherein, in response to the cup compressing the air chamber, the air replenishing pump discharges air from the air chamber through a second one-way valve located at the first outlet port.

14. The smart air pump according to claim 1, wherein the at least one pivot arm comprises a pair of pivot arms located on opposing sides of the core and covering the core opening.

15. An inflatable device comprising:

an inflatable body; and a smart air pump located in the inflatable body, the smart air pump comprising:

a housing defining an accommodating chamber;

a main air pump located in the accommodating chamber and configured to inflate or discharge air from the inflatable body, the main air pump comprising:

a cover defining a first inlet port and a first outlet port, the cover dividing the accommodating chamber into an impeller chamber extending between the housing and the cover and a driving chamber in fluid communication with an outer environment;

an air replenishing pump located in the accommodating chamber and adjacent to the main air pump, the air replenishing pump comprising:

a base, a core coupled to the base, the core defining a second inlet port, a second outlet port, and a core opening, at least one pivot arm, a magnet coupled to the at least one pivot arm, a cup coupled to the at least one pivot arm and to the core, the cup covering the core opening to thereby define an air chamber, and an electromagnetic device configured to generate magnetic flux causing the magnet and the at least one pivot arm to move, thereby causing the cup to comprises and expand the air chamber;

wherein the base defines a first groove and a second groove, the first groove being in fluid communication with the second inlet port to establish a first air passage for directing air into the air chamber via the second inlet port, and the second groove being in fluid communication with the second outlet port for directing air to the outer environment;

a driving switch located in the driving chamber, connected to the main air pump, and configured to perform air passage switching; and a central control unit located in the driving chamber and electrically connected to the main air pump, the air replenishing pump, and the driving switch, the central control unit comprising:

a time control module configured to initiate periodic replenishment of air to the inflatable body, the time control module comprising a setting module for setting a cycle time, and a counting module for counting said cycle time.

16. The inflatable device according to claim 15, wherein the inflatable body includes a top sheet, a bottom sheet, and an enclosing sheet, the enclosing sheet connecting the top sheet with the bottom sheet, thereby defining an interior cavity.

17. The inflatable device according to claim 16, further including a plurality of reinforcing members located in the interior cavity and connected to the top sheet and the bottom sheet.

18. The inflatable device according to claim 15, wherein the inflatable body comprises one of an inflatable bed, an inflatable mattress, an inflatable boat, and an inflatable toy.

19. The inflatable device according to claim 15, wherein, in response to the cup expanding the air chamber, the air replenishing pump draws air into the air chamber through a first one-way valve located at the second inlet port; and, in response to the cup compressing the air chamber, the air replenishing pump discharges air from the air chamber through a second one-way valve located at the second outlet port.

20. The inflatable device according to claim 15, wherein the at least one pivot arm comprises a pair of pivot arms located on opposing sides of the core and covering the core opening.

21. The inflatable device according to claim 15, wherein the cycle time is greater than or equal to thirty seconds.

22. The inflatable device according to claim 21, wherein the cycle time is one of sixty seconds, five minutes, ten minutes, thirty minutes, and one hour.

23. The inflatable device according to claim 15, wherein after activating an inflation function of the smart air pump and deactivating an inflation function of the main air pump, the counting module begins counting for the cycle time and when the counting reaches an end of the cycle time, the air replenishing pump begins to replenish air until an air pressure inside the inflatable body is greater than or equal to a preset air pressure.

24. The inflatable device according to claim 23, wherein the counting module resets upon reaching the end of the cycle time.

* * * * *